United States Patent [19]

Braddock et al.

[11] Patent Number: 4,588,002

[45] Date of Patent: May 13, 1986

[54] HOT MELT ADHESIVE APPLICATOR SYSTEM

[75] Inventors: Richard M. Braddock; Kenneth G. Alexander, both of Melbourne, Australia

[73] Assignee: Alexander Packaging Equipment Pty Ltd., Briar Hill, Victoria, Australia

[21] Appl. No.: 656,624

[22] Filed: Oct. 1, 1984

[30] Foreign Application Priority Data

Oct. 3, 1983 [AU] Australia ..... PG1671

[51] Int. Cl.[4] ..... B65B 3/04

[52] U.S. Cl. ..... 141/18; 141/383; 141/27; 222/146.5

[58] Field of Search ..... 141/1-12, 141/18-29, 346-362, 382-386, 392, 115-127; 222/129, 129.2, 129.3, 129.4, 133, 145, 146.5, 193, 526, 527, 49

[56] References Cited

U.S. PATENT DOCUMENTS 4,137,952 2/1979 Rendemonti ..... 141/27

*Primary Examiner*—Houston S. Bell, Jr.

*Attorney, Agent, or Firm*—Neuman, Williams, Anderson & Olson

[57] ABSTRACT

A hot melt adhesive system wherein a plurality of refill adaptors are spaced from an adhesive source and from each other and are connected to said source by heated pressure hoses whereby molten adhesive is supplied from said source to said refill adaptors, each refill adaptor having connection means for selective connection to a hand held applicator gun whereby a gun may be charged or recharged with molten adhesive at any one of a plurality of spaced locations remote from said source. The applicator gun includes valve actuated means externally of the gun for preventing ejection of molten adhesive through the nozzle during a filling or refilling operation. The gun also includes a plunger extending through a wall of a molten adhesive storage chamber which is adapted to be forced outwardly to a fully extended position when the chamber is full. The plunger is adapted for co-operation with clamp means on a refill adaptor, which clamp means retain said gun in connection with the refill adaptor, whereby outward movement of said plunger is adapted to disengage the clamp means from the gun such that disengagement is complete when said plunger is fully extended.

11 Claims, 3 Drawing Figures

HOT MELT ADHESIVE APPLICATOR SYSTEM

Figure 3:
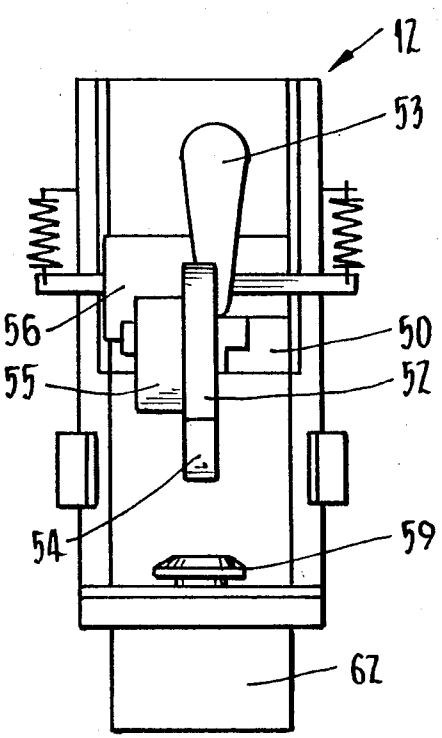

This invention relates to hot melt adhesive applicator systems and in particular relates to an improved system and an improved hot melt hand applicator gun for use in areas where mobility and high use rate are required.

In the past hot melt adhesive has commonly been used in a number of different situations from the sealing of cartons to use in the automotive manufacturing industry and the adhesive is commonly applied from hand held applicator guns. In one form of presently used gun system the hot melt adhesive is supplied to the hand gun in molten form through a heated hose from a hot melt bulk supply tank. This system has the disadvantage that the hose is bulky and heavy as it incorporates a heating element and must be of considerable diameter to allow the molten adhesive to pass through the hose to the gun. The hoses are also very expensive and are vulnerable to damage during use which results in a high equipment cost over a period of time. The weight of the hose also renders them inconvenient in use.

Another commonly used system provides an applicator gun to which the adhesive is supplied in solid form and melted down within the gun. The adhesive is either supplied through a hopper type arrangement on the gun or is loaded into the gun in cartridge form. With the hopper type feed the resultant gun is large, heavy and awkward to use and with the cartridge type of system the supply of adhesive in cartridge form is very expensive. These two systems also have the major disadvantage that considerable time is taken to melt down the solid adhesive once it has been supplied to the gun which results in lengthy delays in operator time which is economically unviable particularly in a production line situation.

A further known system which was designed to overcome the aforementioned problems is described in U.S. Pat. Nos. 4,144,913 and 4,303,108 by Nordson Corporation. According to this more recent development an applicator gun and a molten adhesive source are selectively connectable one with the other to permit charging and recharging of the gun with molten adhesive. Thus the need for a heated hose to deliver molten adhesive to the gun is avoided as is the need to melt the adhesive down within the gun. Therefore, this more recent development as shown in the abovementioned U.S. patents avoids the need for a heavy heated hose to each applicator gun and the need for cumbersome applicator guns incorporating a hopper. Furthermore, the later systems avoid the need to use expensive cartridge type adhesive and the consequent delays which occur while the cartridge is melted down within the gun.

However, there are a number of disadvantages which have come to light in systems of the general kind described in the aforementioned U.S. patents. For example, in high usage situations such as assembly lines where a number of applicator guns are recharged from the same molten adhesive source congestion can occur when several operators require their guns to be refilled at the same time. Furthermore, in situations where the molten adhesive source is a pressurized vessel, various problems can arise for example, immediately when the gun is removed from its connection to the vessel in that residual pressure in the vessel can cause hot molten adhesive to be ejected at the outlet valve particularly if the operator neglects to actuate a pressure relief valve on the vessel. Needless to say, it is dangerous to have hot molten adhesive ejected anywhere where it is likely to contact an operator and the resultant mess around the interconnecting points causes problems in using the apparatus particularly if the adhesive is able to set.

A further disadvantage arises when certain types of applicator guns are refilled from the vessel, in that the adhesive is forced out the nozzle of the gun as well as into the storage chamber and there is a consequent wastage of adhesive not to mention the danger of having molten adhesive ejected from the nozzle and the resultant mess. There is also a problem with most known applicator guns of determining when the adhesive chamber has been completely filled in the course of a refilling operation.

Accordingly, it is an object of this invention to provide an improved hot melt adhesive applicator system and an improved applicator gun therefor which overcome one or more of the aforementioned disadvantages.

Thus, the invention provides a hot melt adhesive applicator system of the kind wherein a hand held applicator gun is selectively connectable to a molten adhesive source to permit charging and recharging with molten adhesive, characterized in that, a plurality of refill adaptors are spaced from said adhesive source and from each other and are connected to said source by heated pressure hoses whereby molten adhesive is supplied from said source to said refill adaptors, each refill adaptor having connection means for selective connection to a said applicator gun whereby a gun may be charged or recharged with molten adhesive at any one of a plurality of spaced locations remote from said source.

Another form of the invention provides a hot melt adhesive applicator gun of the hand held type having a chamber for storing a supply of molten adhesive, an applicator nozzle communicating with said chamber, a control trigger for actuating a piston in said chamber to force molten adhesive from said chamber through said nozzle and a charge valve for enabling said chamber to be filled and refilled with molten adhesive by interconnection with a refill adaptor, characteirzed in that, said gun includes valve means for preventing ejection of molten adhesive through said nozzle during a filling or refilling operation, said valve means being adapted for actuation externally of said gun casing.

A still further form of the invention provides a hot melt adhesive applicator gun of the hand held type having a chamber for storing a supply of molten adhesive, an applicator nozzle communicating with said chamber, a control trigger for actuating a piston in said chamber to force molten adhesive from said chamber through said nozzle and a charge valve for enabling said chamber to be filled and refilled with molten adhesive by interconnection with a refill adaptor, characterized in that, said gun includes a plunger extending through a wall of said chamber and being adapted to be forced outwardly to a fully extended position when said chamber is full, said plunger being adapted for co-operation with clamp means on a refill adaptor, which clamp means retain said gun in connection with said refill adaptor, whereby outward movement of said plunger is adapted to disengage said clamp means from said gun such that disengagement is complete when said plunger is fully extended, said clamp means being adapted to deactivate a filling or refilling operation when disengagement is complete.

Figure 1:
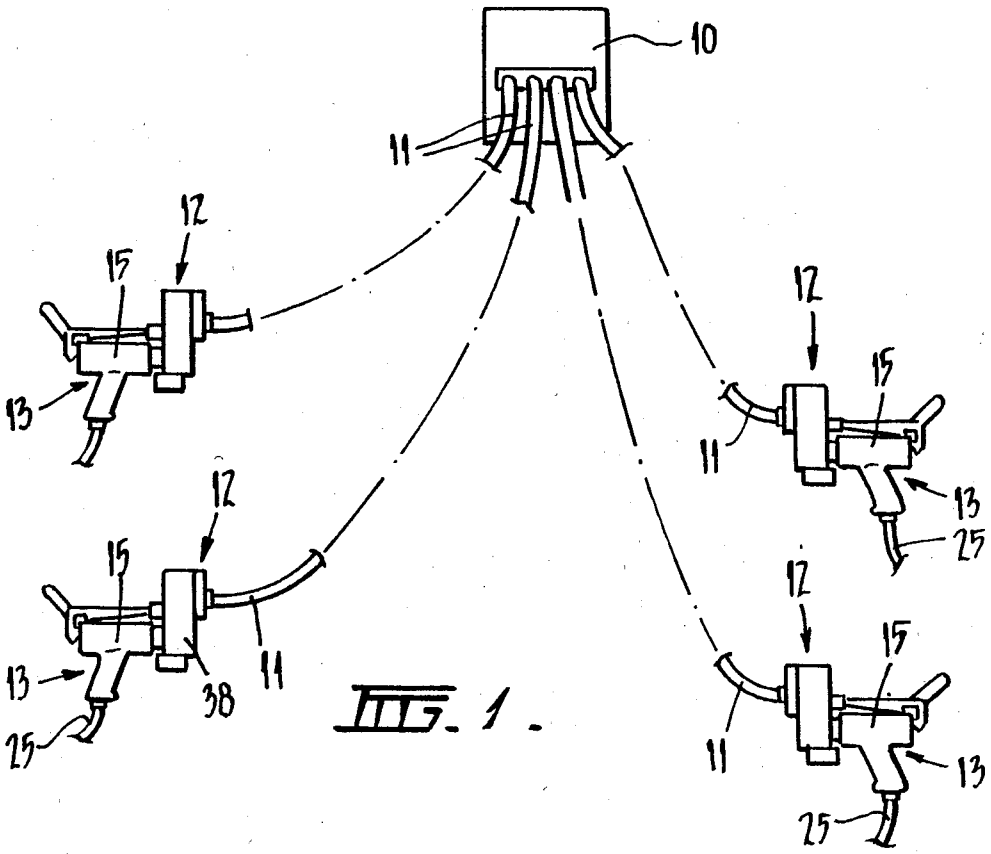
Figure 2:
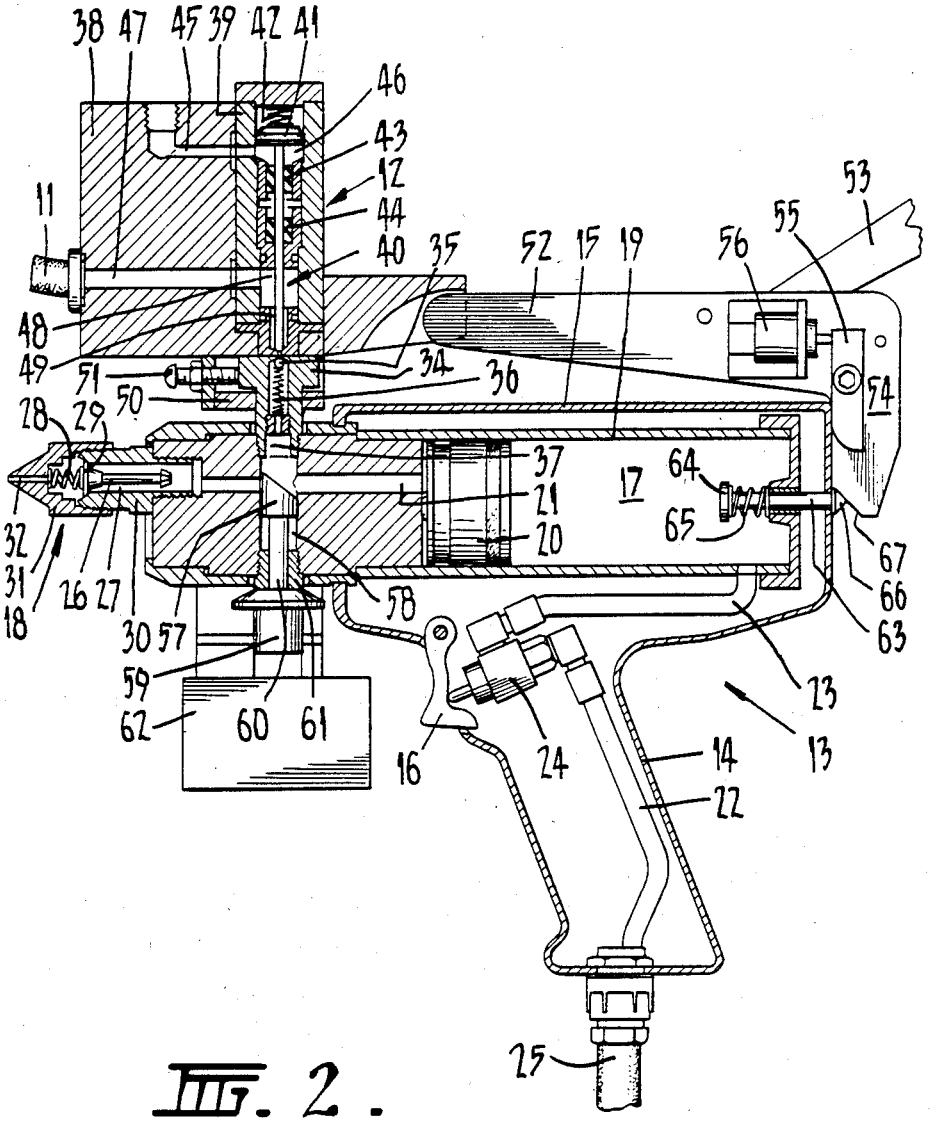

In order that the invention may be more readily understood, one particular embodiment will now be described with reference to the accompanying drawings wherein FIG. 1 is a schematic diagram of a hot melt adhesive applicator system having a plurality of refill adaptors according to one embodiment of the invention;

FIG. 2 is sectional side elevation of a hot melt adhesive applicator gun and a refill adaptor according to the embodiment, and FIG. 3 is an end elevation of the refill adaptor shown in FIG. 2.

Referring in particular now to FIG. 1, it can be seen that the system comprises essentially a hot melt bulk supply tank 10 which is adapted to supply molten adhesive under pressure via each of the supply lines 11 to each of the refill adaptors 12. The supply lines 11 comprise heated pressure hose which is generally fixed in position in a factory or other working environment so that the relatively bulky supply lines are not required to be moved about and are able to be arranged in a most convenient out of the way position. Each of the refill adaptors 12 is adapted to be selectively connected to an applicator gun 13 of the hand held type. The bulk supply tank 10 may be of the kind which has an electric or pneumatic pump (not shown) for dispensing the molten adhesive into the supply lines 11 under pressure or may be of the kind which uses a pressurized tank to force the molten adhesive into the supply lines 11. Preferably, the bulk supply tank 10 is of the former kind using a pneumatic pump (not shown) to force the molten adhesive along the supply lines 11.

Referring now to FIG. 2, the applicator gun 13 is shown to consist essentially of a handle portion 14 incorporating a trigger 16 and a body portion 15 incorporating a storage chamber 17 and a nozzle arrangement 18. The storage chamber 17 is formed within a barrel 19 of cylindrical section which incorporates a piston 20 for forcing molten adhesive into outlet bore 21 and then to the nozzle arrangement 18. The piston 20 is actuated by air pressure which is fed into the storage chamber 17 via air lines 22 and 23 and poppet valve 24 actuated by the trigger 16. An electrical heating element (not shown) is arranged in the barrel 19 to retain the adhesive in a molten state; the electric supply for the heater element being provided by electrical wiring (not shown) to the handle portion 14 along with a flexible pneumatic hose 25 for supplying compressed air to the air lines 22 and 23. The temperature is accurately maintained at the desired temperature by control using a thermister (not shown) which can maintain the temperature to within plus or minus $1\frac{1}{2}$ C.

The nozzle arrangment 18 incorporates a nozzle valve 26 slidable within a bore 27 and spring biased by spring 28 to a closed position wherein a tapered portion 29 is seated in a valve seat in a nozzle retaining nut 30. A nozzle 31 threadably engages the retaining nut 30 and provides an outlet passage 32 for ejection of molten adhesive.

A charge valve arrangement 33 is located on the top of the body portion 15 for the purpose of filling the chamber 17 with molten adhesive. The charge valve arrangement 33 includes a charge valve housing 34 of T-shaped cross-section which houses a ball valve 35 which is spring biased to a closed position during normal use of the gun by means of spring 36. A bore 37 communicates with the charge valve arrangement 33 and the aforementioned bore 21 extending between the chamber 17 and the nozzle arrangement 18. Thus the bore 37 communicates with the chamber 17 and therefore molten adhesive injected into the charge valve housing 34 is able to enter the storage chamber 17.

The applicator gun 13 thus far described is essentially of known construction and the unique features according to the present embodiment will be described hereinbelow. The applicator gun 13 is adapted, by virtue of the charge valve housing 34, for selective connection to a refill adaptor 12 which is shown in more detail in FIGS. 2 and 3. A refill adaptor comprises an adaptor body 38 accommodating a cartridge 39 incorporating a fill valve arrangement 40. The fill valve arrangement consists essentially of piston and rod 41 and return spring 42. An air chamber seal 43 and an adhesive chamber seal 44 are located within the cartridge 39 to form a seal around the rod of the piston and rod 41 for purposes which will become apparent. A port 45 in the adaptor body 38 and cartridge 39 communicates with a chamber 46 between the piston of the piston and rod 41 and the air chamber seal 43. Thus the introduction of pressurized air to the chamber 46 forces the piston against the spring 42 thus opening the valve of the fill valve arrangement 40. A further port 47 through the body 38 and cartridge 39 communicates with a further chamber 48 which communicates via a bore 49 with a valve seat providing access to an opening in the bottom of the cartridge 39. The opening is, in use, aligned with the ball valve 35 of the charge valve arrangement 33 of the applicator gun. The bore 49 is for the purpose of allowing molten adhesive under pressure to be forced from the chamber 48 and through the fill valve arrangement 40 to charge or recharge the chamber 17 of the applicator gun with molten adhesive.

The charge valve arrangement includes a positioning bracket 50 for positively locating the charge valve arrangement of the gun in a position wherein the ball valve 35 is aligned with the bore 49 of the fill valve arrangement 40. The positioning bracket 50 has a T-shaped section corresponding to the shape of the charge valve housing 34 and can be seen more clearly in FIG. 3. Thus, the T-shaped charge valve housing 34 may be slid into the corresponding housing of the fill valve arrangement 40 until the housing 34 abuts against an adjusting screw 51. The adjusting screw enables accurate adjustment of the relative position of the two parts so that the respective bores may be accurately aligned. The positioning bracket 50 prevents transverse movement between the relative parts and movement in a direction away from the adjusting screw 51 is prevented by means of a pivotal lever arm 52 which may be pulled down into a position wherein it clamps the applicator gun in an engaging position with the fill valve arrangement 40.

The lever arm 52 incorporates a loading handle 53 for the purpose of actuating the lever arm 52 such that an end portion 54 bears on the end of the gun 13 for the purpose of holding the gun in the engaged position. The lever arm 52 incorporates a poppet valve striker plate 55 and a poppet valve 56. The striker plate 55 bears on the end of the gun 13 when the lever arm is in the engaged position and is thereby cammed into a position allowing opening of the poppet valve 56. The striker plate 55 is biased in such a manner that in a released position wherein the lever arm 52 is raised away from engagement with the gun 13, it causes closing of the poppet valve 56. The poppet valve is connected to an air line (not shown) which causes operation of the pneumatic pump to pump molten adhesive into the gun 13 via the fill valve arrangement 14 when the lever arm 52 is in the engaged position as shown in FIG. 2.

Returning now to the applicator gun and in particular to FIG. 2, it can be seen that a cut-off valve 57 is provided in a bore 58 arranged to intersect with the outlet bore 21. The cut-off valve 57 is suitably angled to block the bore 21 in a manner whereby communication between the storage chamber 17 and the nozzle 18 is prevented when the cut-off valve 57 is in actuated position as shown in FIG. 2. In this actuated position, communication is facilitated between the bore 37 and the portion of the bore 21 extending into the chamber 17. Thus, with the cut-off valve 57 in the actuated position as shown in FIG. 2, molten adhesive is able to pass into the storage chamber 17 from the fill valve arrangement but is unable to pass into the nozzle arrangement 18 and thus the possibility of any molten adhesive being ejected through the nozzle 31 during a filling or refilling operation if obviated.

The cut-off valve 57 is actuated by means of a plunger 59 which bears on the bottom end of a valve stem 60 projecting through the bottom of the applicator gun body within a retaining screw 61. The plunger 59 is operated by means of compressed air from air cylinder 62 which is controlled by the poppet valve 56 in a manner whereby the plunger is actuated when the lever arm 52 is in the engaged position shown in FIG. 2. The return of the cut-off valve 57 to a downward position whereby the bore 21 is clear to allow communication between the chamber 17 and the nozzle arrangement 18 is caused by gravity and/or the pressure of adhesive through the bore 21 when the applicator gun is in use.

A further feature of the applicator gun 13 relates to means for establishing when the storage chamber 17 has been filled or refilled with molten adhesive and shutting off the supply of adhesive from the fill valve arrangement 40. Such means comprises a plunger 63 which is located axially at the outer end of barrel 19 so as to extend from the inside of the chamber 17 through the end of the barrel and out through the end casing of the gun 13. The plunger 63 has an inner end cap 64 for retaining a compression spring 65 to bias the plunger towards an inner position wherein an outer conical head 66 is against the outer casing of the gun. As can be seen clearly in FIG. 2 when the gun is in the initial refill position and the chamber 17 is empty, the plunger 63 is fully retracted and the conical head 66 is in contact with a tapered edge 67 of the lever arm 52. As the chamber 17 refills, the piston 20 is forced to the right hand side in FIG. 2 until it bears on the end cap 64 of the plunger. Further movement of the piston 20 forces the conical head 66 against the tapered edge 67 ultimately forcing the lever arm 52 away from its interlocking position over the gun 13. As the lever arm 52 moves away from the gun 13, the poppet valve striker plate 55 returns to a position causing closure of poppet valve 56. The closure of poppet valve 56 of course shuts off the supply of compressed air to the pump of the fill valve arrangement 40 and consequently the supply of molten adhesive to charge the gun is ceased. Closing of the poppet valve 56 also cuts off the supply of compressed air to the chamber 46 allowing the piston and rod 41 to move downwardly under the force of spring 42 whereby the valve of the fill valve arrangement 40 is closed.

Once the lever arm 52 is removed from engagement with the gun with the consequent closure of the fill valve, the gun 13 may be removed from its connection to the fill valve arrangement 40 by sliding the charge valve arrangement 33 out of its engaged position with the positioning bracket 50. The gun is then recharged ready for use and the fill valve arrangement 40 may be utilized by another operator for similar purposes.

It should be evident that the applicator gun and the general system described hereinabove provides a number of distinct advantages over existing applicator guns and systems for use thereof. For example, a system having a plurality of fill or refill adaptors at spaced locations around a working environment avoids congestion at a single bulk supply tank and also facilitates location of the adaptors closer to the working position of a user. The unique fill valve arrangement which is actuated by a lever arm which positively locates the gun in position on the adaptor avoids the ejection of molten adhesive when the gun is disconnected from the adaptor. Furthermore, the cut-off valve 57 prevents ejection of molten adhesive through the gun nozzle during the refill procedures and thus obviates one of the aforementioned difficulties of prior art guns. Also, there is no possibility of trying to overfill the storage chamber in the gun since the automatic fill-trip mechanism involving the plunger 63 ensures that the supply of molten adhesive is stopped as soon as the chamber is filled. Of course various modifications may be readily made to the system and applicator gun described above since various combinations of the features may be used in different applications.

We claim:

1. A hot melt applicator system comprising a molten adhesive source, a plurality of refill adaptors spaced from and connected to said molten adhesive source by heated pressure hoses, means for connecting each refill adaptor to a hand held applicator gun whereby said gun may be charged or recharged with molten adhesive at any one of a plurality of spaced locations remote from said source, said hand held applicator gun having a chamber for storing a supply of molten adhesive and an applicator nozzle communicating with said chamber and a control trigger for actuating a piston in said chamber to force molten adhesive from said chamber through said nozzle.

2. A system as defined in claim 1 wherein each said refill adaptor has plunger means adapted to operate a cut-off or by-pass valve on said gun to prevent molten adhesive from being ejected through the gun nozzle during a filling or refilling operation.

3. A system as defined in claim 1 wherein each said refill adaptor has a discharge valve adapted for connection to a charge valve on said applicator gun.

4. A system as defined in claim 3 wherein each said refill adaptor has clamp means for temporarily retaining said gun in a position wherein said discharge and charge valves are interconnected during a filling or refilling operation.

5. A system as defined in claim 4 wherein said clamp means is a lever arm incorporating valve means for causing the flow of molten adhesive into said gun when said lever arm is brought into a position for retaining said gun during a filling of refilling operation.

6. A hot melt adhesive applicator gun of the hand held type having a chamber for storing a supply of molten adhesive, an applicator nozzle communicating with said chamber, a control trigger for actuating a piston in said chamber to force molten adhesive from said chamber through said nozzle and a charge valve for enabling said chamber to be filled and refilled with molten adhesive by interconnection with a refill adaptor, a valve means within said gun for preventing ejection of molten adhesive through said nozzle during a filling or refilling operation, said valve means being adapted for actuation externally of said casing.

7. An applicator gun as defined in claim 6 wherein said valve means comprises a cut-off valve located in a fill bore intersecting with a nozzle bore such that movement of said valve in one direction within said fill bore closes said nozzle bore whilst enabling said fill bore to communicate with said chamber and movement of said valve in a direction opposite to said one direction opens said nozzle bore for communication with said chamber.

8. An applicator gun as defined in claim 6 wherein said valve has a stem extending externally of said casing for facilitating actuation of said valve.

9. An applicator gun as defined in claim 6 and including means adapted to indicate when said chamber is full and to trip a fill valve control mechanism to stop the filling or refilling operation when said chamber is full of molten adhesive.

10. An applicator gun as defined in claim 9 wherein said means adapted to indicate comprises a plunger extending through a wall of said chamber and adapted to be forced outwardly to a fully extended position when said chamber is full, said plunger being adapted for co-operation with clamp means on a refill adaptor, which clamp means retain said gun in connection with said refill adaptor, whereby outward movement of said plunger is adapted to disengage said clamp means from said gun such that disengagement is complete when said plunger is fully extended, said clamp means being adapted to deactivate a filling or refilling operation when disengagement is complete.

11. A hot melt adhesive applicator gun of the hand held type having a chamber for storing a supply of molten adhesive, an applicator nozzle communicating with said chamber, a control trigger for actuating a piston in said chamber to force molten adhesive from said chamber through said nozzle and a charge valve for enabling said chamber to be filled and refilled with molten adhesive by interconnection with a refill adaptor, characterized in that, said gun includes a plunger extending through a wall of said chamber and being adapted to be forced outwardly to a fully extended position when said chamber is full, said plunger being adapted for co-operation with clamp means on a refill adaptor, which clamp means retain said gun in connection with said refill adaptor, whereby outward movement of said plunger is adapted to disengage said clamp means from said gun such that disengagement is complete when said plunger is fully extended, said clamp means being adapted to deactivate a filling or refilling operation when disengagement is complete.

* * * * *